US005975456A

United States Patent [19]

Bodkin et al.

[11] Patent Number: 5,975,456

[45] Date of Patent: Nov. 2, 1999

[54] ADJUSTABLE WEB CUTTER

[75] Inventors: Elizabeth Tucker Bodkin, Clifton Forge; Andy Theodore Davis; Clifford Brooks Persinger, both of Covington, all of Va.

[73] Assignee: Westvaco Corporation, New York, N.Y.

[21] Appl. No.: 09/065,244

[22] Filed: Apr. 23, 1998

[51] Int. Cl.[6] ..... B65H 35/02

[52] U.S. Cl. ..... 242/525.3; 242/525.5; 242/546.1; 242/592; 83/425; 83/649

[58] Field of Search ..... 242/525.1, 525.3, 242/525.5, 546.1, 592, 534.1; 83/425, 425.2, 425.3, 648, 649

[56] References Cited

U.S. PATENT DOCUMENTS

| | | |
|---|---|---|
| 400,603 | 4/1889 | Schofield . |
| 908,313 | 12/1908 | Nelson . |
| 1,170,652 | 2/1916 | Maimin . |
| 3,973,459 | 8/1976 | Stowe . |
| 4,373,412 | 2/1983 | Gerber et al. . |
| 4,579,025 | 4/1986 | Fasolak . |
| 4,683,791 | 8/1987 | Demont . |
| 4,818,343 | 4/1989 | Laine . |

OTHER PUBLICATIONS

TAPIO Technologies Oy, "Your Sample Cutting Problems With Tapio CutOff," Tapio User's Manual version 2.01e, Nov. 5, 1997.

*Primary Examiner*—Donald P. Walsh
*Assistant Examiner*—William Rivera
*Attorney, Agent, or Firm*—J. R. McDaniel; R. L. Schmalz

[57] ABSTRACT

An adjustable web cutter which allows web samples to be cut in various lengths, width and thickness while employing a disposable cutter blade.

17 Claims, 5 Drawing Sheets

ADJUSTABLE WEB CUTTER

BACKGROUND OF THE INVENTION

1. Field of the Invention

This invention relates to adjustable web cutters. Such structures of this type, generally, allow web samples to be cut in various lengths, widths and thicknesses while employing a disposable cutter blade.

2. Description of the Related Art

It is known, in a mat cutting apparatus, to employ a single edge razor blade which is mounted to cut on an angle. Exemplary of such prior art is U.S. Pat. No. 3,973,459 ('459) to C. P. Stowe, entitled "Mat Cutting Apparatus". The '459 reference employs a blade that moves while cutting a stationary piece of mat, but the blade cannot be inverted when dulled. Also, the blade cannot be set in more than one position.

It is also known, in paper cutting systems, to employ a portable cutter which uses round slitter blades. Exemplary of such prior art is the "cutoff" system, manufactured by TAPIO Technologies of Finland. While the TAPIO system uses chain tensioning that requires lubrication, it also employs round slitter blades which cut with a scissor effect. However, the slitter blades must be sharpened at a machine shop, which adds to the operating expense. While the TAPIO system is portable, it must be bolted to a work top. Also, the system uses a feed plate which must also be fixed to the work top. Finally, while the TAPIO system employs a fixed hand wheel to wind the paper, it can only cut fixed-width rolls.

Consequently, a more desirable web cutter would be one which (1) tightly winds the web sample that is cut, (2) utilizes standard, replaceable blades, which are readily accessible at any hardware store, (3) the blades are protected by a safety shield, (4) the cutter is adjustable for several core widths, (5) the cutter will support rolls with variable diameters, allowing numerous cross-directional (CD) samples to be wound on one core, (6) the cutter is free-standing, thereby allowing various support surfaces to be utilized, (7) the height of the cutter is adjustable, (8) the cutter allows for sample winding with the felt or wire-side of the web facing out, (9) the cutter employs an interchangeable handle to allow for both left-handed and right-handed operation, (10) the cutter is portable and easily assembled and (11) the cutter requires no lubrication.

It is apparent from the above that there exists a need in the art for a web cutter which is lightweight through simplicity of parts and uniqueness of structure, and which at least equals the cutting characteristics of the known cutters, but which at the same time avoids all of the previously mentioned downfalls of the known cutters.

It is a purpose of this invention to fulfill this and other needs in the art in a manner more apparent to the skilled artisan once given the following disclosure.

SUMMARY OF THE INVENTION

Generally speaking, this invention fulfills these needs by providing an adjustable web cutter, comprising a supply of a web material, a base plate means, an adjustable cutting means operatively attached to the base plate means which is adjustable in a first direction, and a web supply take-up means operatively attached to the base plate means, located adjacent to the cutting means and adjustable in said first direction and a second direction.

In certain preferred embodiments, the base plate means includes a friction reduction means. Also, the cutting means includes a plurality of guide rollers, a plurality of cutting blades, a plurality of safety devices and the cutting means is adjustable in a linear direction. Finally, the web supply take-up means includes a crank and a winder shaft which is adjustable in a linear direction.

In another further preferred embodiment, various kinds of web materials can be cut and tightly wound by using a cutting device which has replaceable blades, is adjustable in various directions and is portable.

The preferred cutter, according to this invention, offers the following advantages: lightness in weight; ease of assembly and repair; excellent cutting characteristics; good stability; good durability; excellent safety characteristics; excellent economy; adjustability; and portability. In fact, in many of the preferred embodiments, these factors of lightness in weight, ease of assembly, cutting characteristics, adjustability, portability, economy, and safety are optimized to the extent that is considerably higher than heretofore achieved in prior, known cutters.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
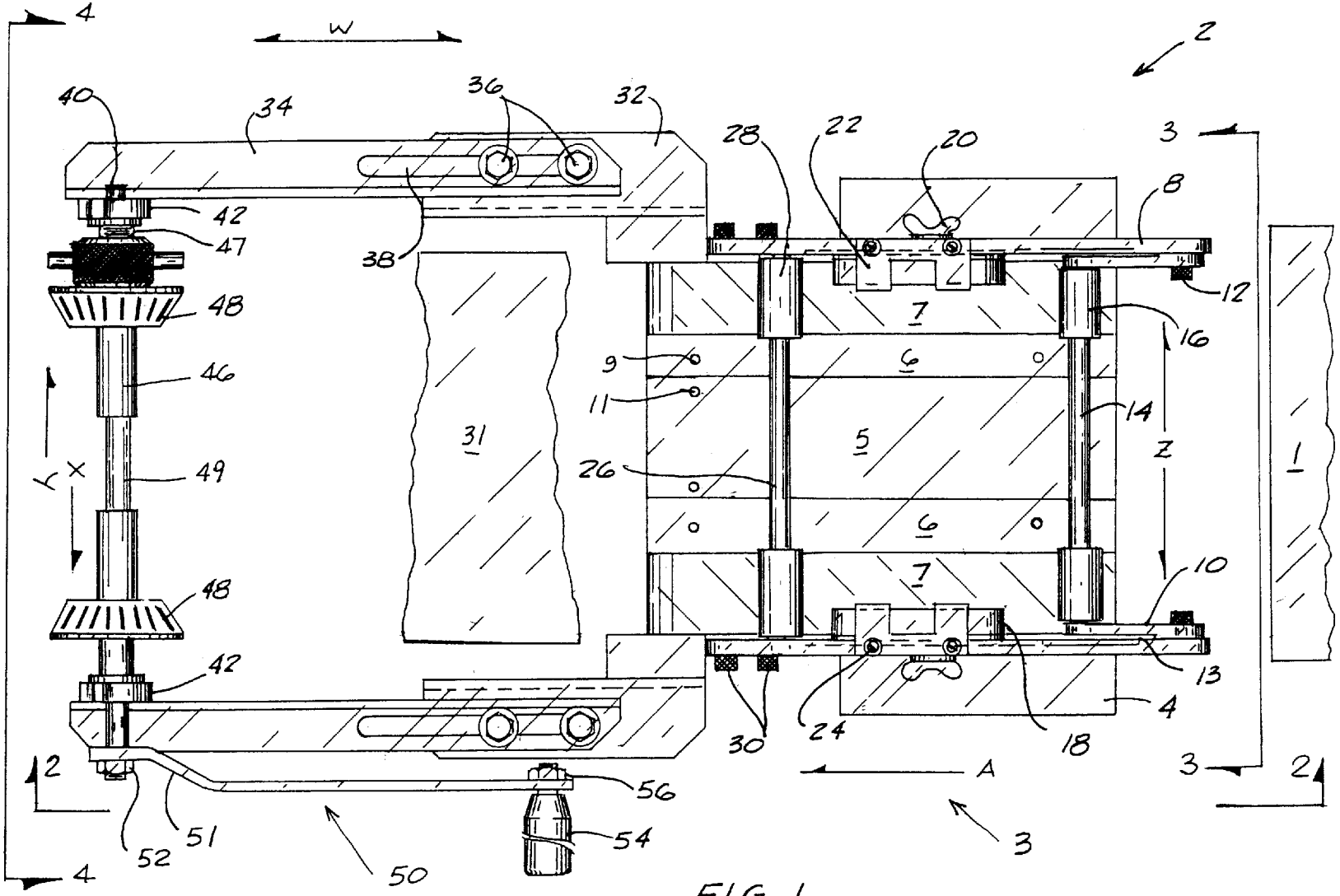
FIG. 1 is a top plan view of an adjustable web cutter, according to the present invention.

With reference first to FIG. 1, there is illustrated an advantageous environment for the use of the concepts of the present invention. In particular, adjustable web cutter 2 is illustrated. Cutter 2 includes, in part, web 1, cutting assembly 3, cut web sample 31 and winding assembly 50.

Cutter assembly 3 includes, in part, base plate 4, bracket support 5, cutting plates 6, friction reduction strips 7, cutter bracket 8, conventional fasteners 9, roller arm 10, conventional threaded holes 11, conventional fasteners 12, shaft 14, rollers 16, cutter blade assembly 18, fastener 20, safety shield 22, conventional fasteners 24, shaft 26, rollers 28 and conventional fasteners 30.

Preferably, base plate 4, bracket support 5, cutter plates 6, cutter bracket 8, roller arm 10, shaft 14, rollers 16, safety shield 22, shaft 26 and rollers 28 are constructed of any suitable, durable metallic material, such as, stainless steel. Strips 7, preferably, are strips of polytetrafluroethylene (Teflon®) conventionally adhered to cutter plates 6. Fastener 20, preferably, is a winged-nut fastener which allows for the easy removal/adjustment of cutter assembly 18.

Fasteners 9 and holes 11 allow for cutter assembly 3 to be adjusted along the direction of arrows Z. Cutter plates 6 are attached to brackets 5 by conventional techniques such that gap 13 is created between cutter plates 6 and brackets 5 in order for blade 21 (FIG. 2) to cut web 1 into sample 31. Cutter bracket 8 is rigidly attached to bracket support 5 by fasteners 30. Shaft 14 is rigidly attached to roller arm 10. Roller arm 10 is pivotally attached to cutter bracket 8 by fasteners 12. Safety shield 22 is rigidly attached to cutter bracket 8 by fasteners 24. Rollers 16 and 28 slide along shafts 14 and 26, respectively, as cutter assembly 3 is adjusted along the directions of arrow Z. Shafts 14 and 26 are attached to shafts 16 and 28, respectively, by conventional fasteners (not shown) once the proper adjustment is achieved.

Winding assembly 50 includes, in part, support arm 32, slotted sample roll support 34, conventional fasteners 36, slot 38, shaft 40, bearings 42, threaded tensioner 44, shaft 46 having threaded end 47, removable chuck 48, adjustment shaft 49, crank 51, conventional fastener 52, handle 54 and conventional fastener 56.

Preferably, support arm 32, slotted sample roll support 34, shaft 40, tensioner 44, shaft 46, chuck 48, shaft 49, crank 51, and handle 54, are constructed of any suitable, durable metallic material, such as, stainless steel. Bearings 42 include a conventional polymeric insert (not shown) and a slot 41 (FIG. 2) upon which shaft 40 rotates.

Figure 2:
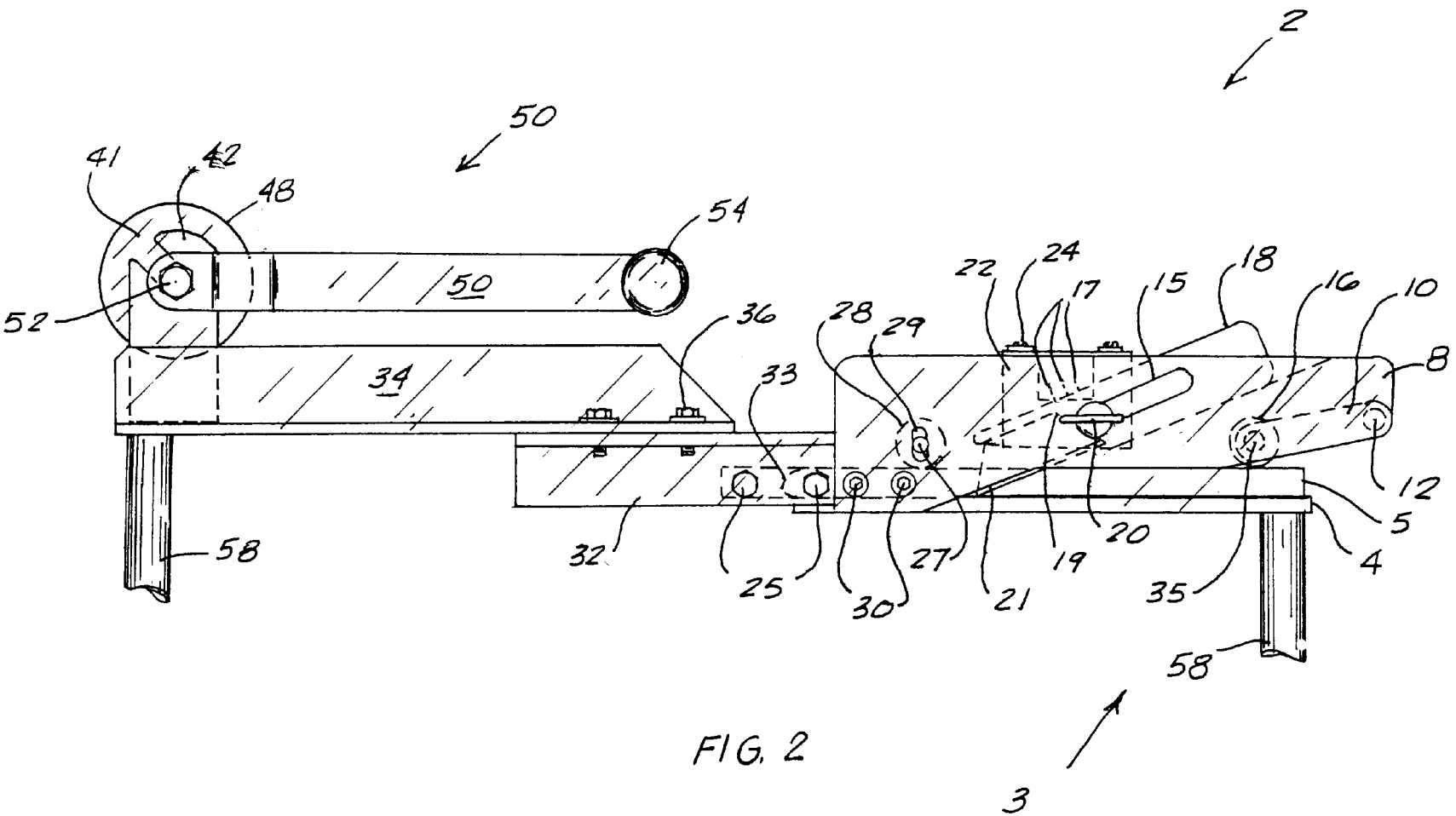
FIG. 2 is a side plan view of the adjustable web cutter, taken along lines 2—2 of FIG. 1, according to the present invention.

Support arm 32 is rigidly attached to bracket support 5 by conventional fasteners 25 (FIG. 2). Tensioner 44 is threaded by conventional techniques. Fasteners 36 allow the distance between winding assembly 50 and cutting assembly 3 to be adjusted along slot 38 in the direction of arrows W. Both parts of shaft 46 slide along adjustment shaft 49 in the direction of arrows X and Y.

With reference to FIG. 2, many of the elements illustrated in FIG. 1 are also shown in FIG. 2. Also, FIG. 2 illustrates more clearly slot 15, blade positioner 17, cutter blade assembly 18, notch 19, blade 21, conventional threaded fasteners 25, shaft 27, slot 29, taper 33, shaft 35, slot 41, and conventional legs 58 which are used to support cutter system 2. Shafts 27 and 35 and legs 58, preferably, are constructed of any suitable, durable material, such as stainless steel.

Taper 33 allows cut sample 31 of web material to move from cutter assembly 3 to winding assembly 50 without experiencing any friction at the end of cutting plate 6. Each roller 16 includes a shaft 35. Shaft 35 allows rollers 16 to rotate while rollers 16 are attached to shaft 14 (FIG. 1). Also, each roller 28 includes a shaft 27. Shaft 27 allows rollers 28 to rotate while roller 28 are attached to shaft 26 (FIG. 1).

Figure 3:
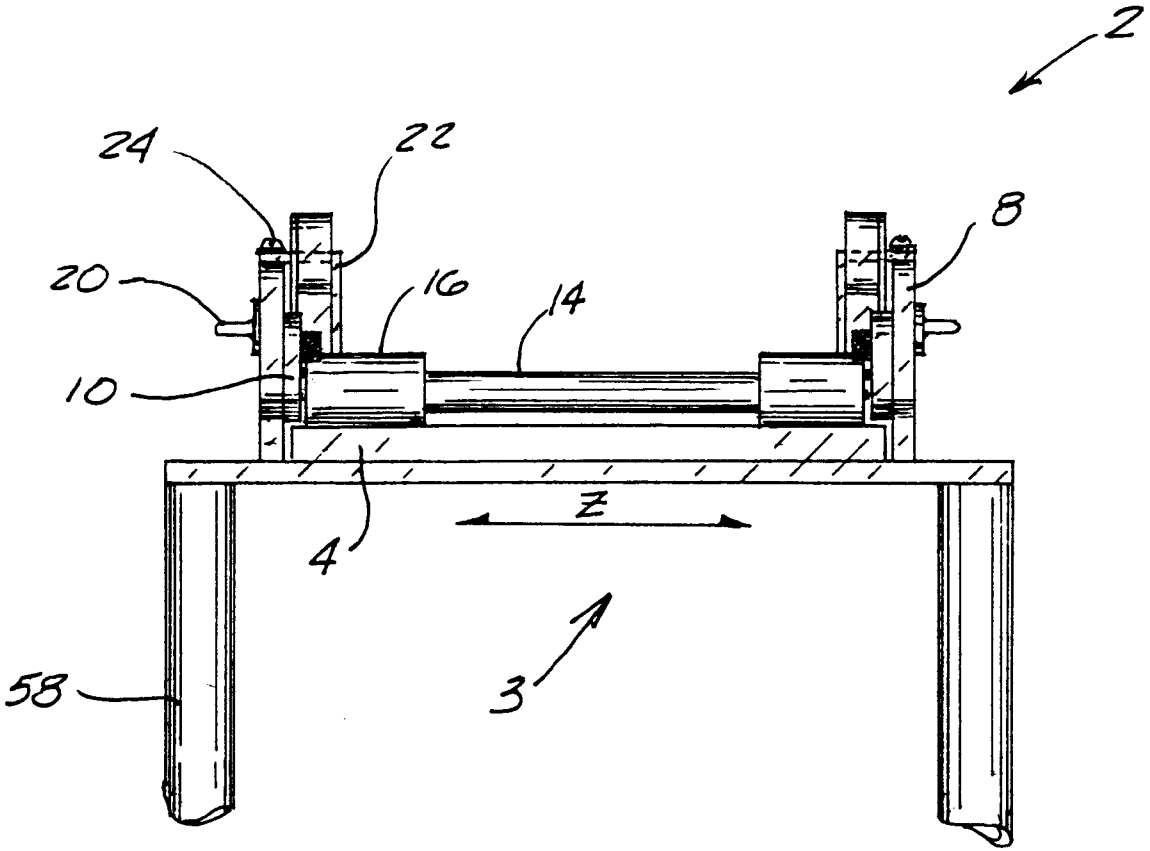
FIG. 3 is an end plan view of the adjustable web cutter, taken along lines 3—3 of FIG. 1, according to the present invention.

FIG. 3 illustrates an end view of cutter 2. In particular, cutting assembly 3 can be seen in this end view. This is the direction in which the web 1 to be cut is first feed into cutter 2 along the direction of arrow A (FIG. 1). Rollers 16 are raised so that the web 1 to be cut can be inserted into cutter 2. Rollers 16 are then lowered to keep web 1 in place.

Figure 4:
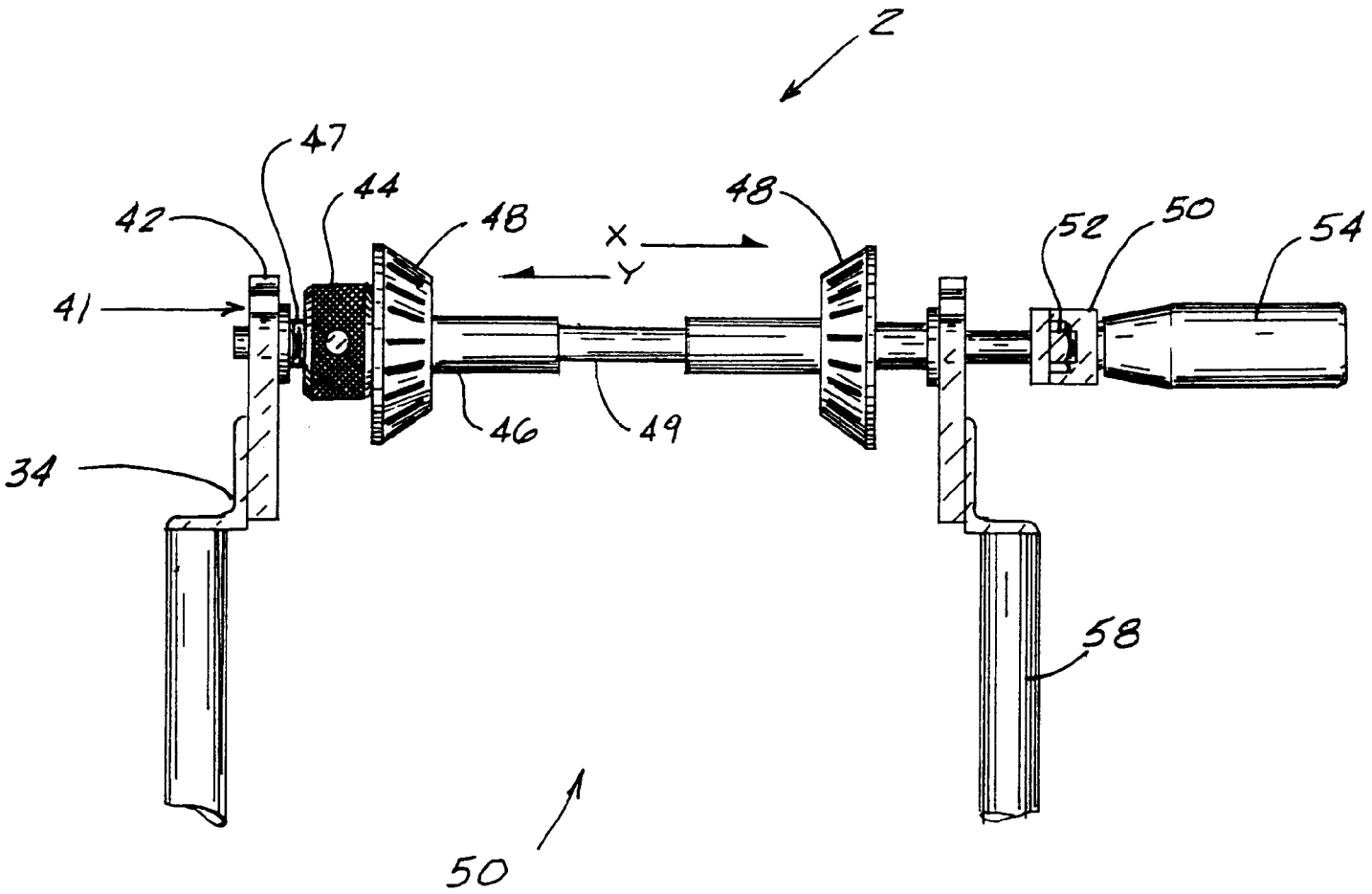
FIG. 4 is another end view of the adjustable web cutter, taken along lines 4—4 of FIG. 1, according to the present invention.

Finally, FIG. 4 is an illustration of wind up assembly 50 of cutter 2. The cut web sample 31 is rolled onto winding shaft 46 after being cut at cutting assembly 3. Shaft 46 slides along adjustment shaft 49 in the direction of arrows X and Y if different the lengths of the core roll (not shown) are to be used in winding of web sample 31.

Figure 5:
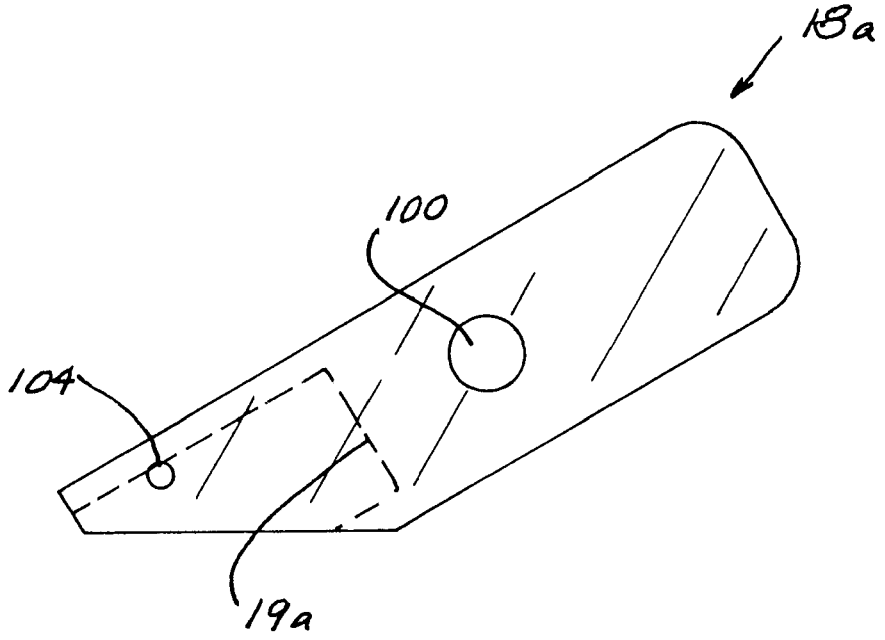
FIGS. 5 and 6 are side plan views of a cutter blade holder for the adjustable web cutter, according to the present invention.
Figure 6:
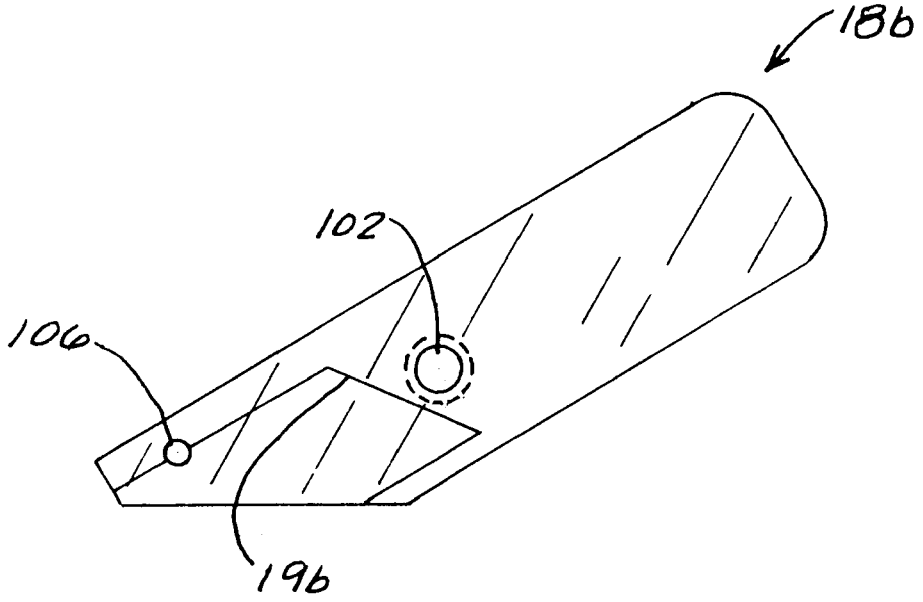

FIGS. 5 and 6 illustrate cutting blade holders 18*a* and 18*b*, respectively. Cutting blade holder 18*a*, preferably, is located adjacent bracket 2 and includes slot 19*a*, hole 100 and rod 104. Cutting blade holder 18*a* and rod 104, preferably, are constructed of any suitable, durable metallic material. Rod 104 is attached to cutter blade assembly 18*a* by conventional techniques, such as soldering.

Cutting blade holder 18*b* includes, slot 19*b*, conventional threaded hole 102 and hole 106. Cutting blade holder 18*b*, preferably, is constructed of the same material as holder 18*a*. Hole 106 is used to mate up with rod 104 of holder 18*a* after blade 21 is placed in notch 19*a* so that blade 21 extends from holder 18*b*. Threaded hole 102 is threaded onto conventional fastener 20 (FIGS. 1 and 2) to rigidly attach cutter blade assembly 18 to bracket 8 and, thereby, hold cutting blade 21 (FIG. 2) securely in place.

During the operation of cutter 2, a web 1 of material, such as paper, cloth or the like, is fed into cutter 2 at cutting mechanism 3. The web is fed under roller 16. As web 1 is fed past blades 21 cut web sample 31 is made. Sample 31 is then fed past rollers 28. After paper sample 31 is fed past rollers 28, sample 31 is conventionally wound upon a core (not shown) which is located on removable chuck 48. The operator merely has to rotate crank 50 by handle 54 in order to draw the web of cut sample 31 past rollers 16 and 28 (along the direction of arrow A) so that the web is cut by blade 21.

One of the important features of the present invention is that blade 21 can be adjusted so that a new cutting surface of blade 21 contacts web 1 as cut sample 31 is being cut. Adjustment markings 17 (FIG. 2) indicate locations of blade 21 along bracket 8. The operator merely has to loosen fastener 20 such that blade holder 18 slides along slot 15 so that a new portion of blade 21 will contact web 1. After the operator has located blade holder 18 to a new position, the operator merely tightens fastener 20 so that blade holder 18 is securely locked in place. After blade 21 is totally used up, it is easily removed, discarded and another inexpensive blade inserted in its place.

Another important feature of the present invention is the adjustability of brackets 8 along the direction of arrows Z (FIG. 1). Depending upon the width of cut sample 31, brackets 8 can be adjusted to accommodate various sample cut widths. In particular, fasteners 9 (FIG. 1) and the fasteners in rollers 16 and 28 are loosened. Brackets 8 can be moved along the directions of arrows Z to accommodate the desired width of cut sample 31 by, preferably, lining up fastener 9 with one of the holes 11 (FIG. 1) on bracket support 5 (FIG. 1). Once the desired width has been obtained, fasteners 9 are secured into holes 11 by conventional techniques and the fasteners on rollers 16 and 28 are tightened to secure rollers 16 and 28 to shafts 14 and 26, respectively.

Still, another important features of the present invention is the safety shield 22. As shown in FIGS. 1 and 2, shield 22 is rigidly attached to bracket 8 by fasteners 24 and shields the operator from coming into contact with blade 21 while cutter 2 is being operated.

Yet, a further advantage of the present invention is the adjustability of chuck 48. The operator merely lifts up on shaft 46 so that shaft 40 is removed from bearings 42. The operator rotates threaded tensioner 44 so that tensioner 44 is rotated along the threaded section 47 of shaft 46 in the direction of arrow Y and removed from shaft 46. Shaft 46 is inserted through the roll core (not shown). Tensioner 44 is then placed over the threaded section 47 of shaft 46 and rotated along the direction of arrow X until chuck 48 tightly holds the roll core onto shaft 46. Also, shaft 46 slides along adjustable shaft 49 if lengths of the core roll (not shown) are varied. Chuck 48 will support rolls of various diameters, allowing numerous cross-directional (CD) samples to be tightly wound on one core.

Also, the design of adjustable chuck 48 allows for interchangeable crank handle 51 for both left-handed and right-handed operation.

Also, it is important to point out that cutter 2 is free-standing which allows various support surfaces to be utilized. Finally, the height of cutter 2 from the floor (not shown) can be made adjustable. Consequently, this makes cutter 2 very portable and easily assembled.

Finally, either the top or the bottom of the web can be cut into samples 31 with the same degree of ease.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. An adjustable web cutter, wherein said cutter is comprised of:

a supply of a web material;

a base plate wherein said base plate is further comprised of;

a plate and a cutter bracket support operatively connected to said plate;

an adjustable cutting means operatively attached to said base plate which is adjustable in a first direction wherein said adjustable cutting means is further comprised of;

a cutter bracket rigidly attached to said cutter bracket support, a plurality of rollers operatively attached to said cutter bracket, a cutter blade assembly adjustably attached to said bracket and located substantially between said plurality of rollers, and a cutter blade assembly safety means operatively attached to said cutter bracket to prevent an operator from coming into contact with said cutter blade assembly during the operation of said cutter; and a web supply take-up means for taking up a cut supply of web material operatively attached to the base plate, located adjacent to said cutting means and adjustable in said first direction and a second direction.

2. The cutter, as in claim 1, wherein said cutter is further comprised of:

a cutting plate operatively attached to said plate means.

3. The cutter, as in claim 2, wherein said plate is further comprised of:

a friction reduction means secured to said cutting plate means adjacent to said cutting means for reducing friction between said cutting means and said web material.

4. The cutter, as in claim 3, wherein said friction reduction means is further comprised of:

a plurality of polymeric strips.

5. A cutter, as in claim 2, wherein said base plate is further comprised of:

a cutter adjustment means for adjusting said adjustable cutting means in said first direction.

6. The cutter, as in claim 5, wherein said cutter adjustment means is further comprised of:

a plurality of holes located substantially in said plate means; and a plurality of fastening means located on said cutting plate means.

7. The cutter, as in claim 1, wherein said cutter blade assembly is further comprised of:

a cutter blade holder having a cutter blade opening;

a cutter blade located partially in said opening and rigidly retained in said holder; and a cutter blade assembly adjustment means for adjusting said cutter blade assembly.

8. The cutter, as in claim 7, wherein said cutter blade assembly adjustment means is further comprised of:

a slot located substantially in said bracket;

an adjustment measurement means located adjacent to said slot for measuring an adjustment of said cutter blade assembly;

a threaded hole located substantially in said cutter blade holder; and a threaded fastener located through said slot and in said threaded hole in said cutter blade holder to adjustably attach said cutter blade assembly to said bracket means.

9. The cutter, as in claim 1, wherein said web supply take-up means is further comprised of:

a take-up support arm rigidly attached to said adjustable cutting means;

a take-up roll support adjustably attached to said take-up support arm to adjust said web-supply take-up means in said second direction; and a web supply winding means operatively attached to said take-up roll support.

10. The cutter, as in claim 9, wherein said take-up roll support is further comprised of:

a slotted bearing.

11. The cutter, as in claim 9, wherein said web supply winding means is further comprised of:

a threaded shaft rotatably attached to said take-up roll support;

an adjustable, threaded roll holder operatively attached to said threaded shaft for adjusting said web supply take-up means in said first direction; and a roll holder rotation means operatively attached to said threaded shaft for rotating said roll holder.

12. The cutter, as in claim 11, wherein said adjustable, threaded roll holder is further comprised of:

a chuck operatively attached to said threaded shaft; and a threaded chuck adjustment means located adjacent to said chuck and operatively connected to said threaded shaft for adjusting said chuck.

13. The cutter, as in claim 11, wherein said roll holder rotation means is further comprised of:

a crank operatively attached to said threaded shaft; and a handle operatively attached to said crank.

14. A method of cutting a web using an adjustable web cutter, including a supply of a web material, a base plate, an adjustable cutting means operatively attached to the base plate means which is adjustable in a first direction, and a web supply take-up operatively attached to said base plate, located adjacent to said cutting means and adjustable in said first direction and a second direction, wherein said method is comprised of the steps of:

translating said supply of said web material to said adjustable cutting means;

cutting a desired sample of said web material from said supply of said web material;

removing excess supply of said web material; and winding said cut sample by said web supply take-up means.

15. The method, as in claim 14, wherein said cutter further includes a plate and a cutter bracket support operatively connected to said plate means, wherein said method is further comprised of the steps of:

determining a desired width of said cut sample;

measuring said desired width of said cut sample between said cutter bracket support; and rigidly affixing said cutter bracket support to said plate.

16. The method, as in claim 14, wherein said cutter further includes a chuck adjustment located adjacent to said chuck, wherein said method is further comprised of the steps of:

determining a desired width of a cut sample take-up roll;

measuring said desired width of said take-up roll between said chuck adjustment; and operating said chuck adjustment to secure said cut sample take-up roll in said chuck.

17. The method, as in claim 14, wherein said cutter further includes a take-up support arm rigidly attached to said adjustable cutting means, a take-up roll support means adjustably attached to said take-up support arm to adjust said web-supply take-up in said second direction, and a web supply winding means operatively attached to said take-up roll support, wherein said method is further comprised of the steps of:

determining a desired distance between said adjustable cutting means and said web supply take-up;

measuring said desired distance between said adjustable cutting means and said web supply take-up; and adjusting said take-up roll support means.

* * * * *